US006536362B2

(12) United States Patent
Clarke

(10) Patent No.: US 6,536,362 B2
(45) Date of Patent: Mar. 25, 2003

(54) MULTIPLE POSITION SEWING SYSTEM

(76) Inventor: Charles Clarke, 1300 S. Ocean Blvd., Apt. 901, Pompano Beach, FL (US) 33062

( * ) Notice: Subject to any disclaimer, the term of this patent is extended or adjusted under 35 U.S.C. 154(b) by 0 days.

(21) Appl. No.: 09/846,132

(22) Filed: May 1, 2001

(65) Prior Publication Data

US 2002/0059890 A1 May 23, 2002

Related U.S. Application Data

(60) Provisional application No. 60/252,056, filed on Nov. 20, 2000.

(51) Int. Cl.[7] ..... D05B 23/00
(52) U.S. Cl. ..... 112/217.2
(58) Field of Search ..... 112/217.1, 217.2, 112/217.3, 155; 108/25, 54.1, 139, 142; 312/135, 125, 208.5, 208.6, 215, 249.2, 319.7, 349, 350; 248/658, 664, 131, 188.1, 349.1, 91.7, 922, 921

(56) References Cited

U.S. PATENT DOCUMENTS

| | | | | | |
|---|---|---|---|---|---|
| 2,065,428 | A | * | 12/1936 | Chason | 112/217.3 |
| 3,450,080 | A | * | 6/1969 | Klose | 112/217.2 |
| 3,936,026 | A | * | 2/1976 | Hampel et al. | 174/70 R |
| 4,116,147 | A | * | 9/1978 | Matthews | 112/217.1 |
| 4,279,453 | A | * | 7/1981 | Haas | 112/217.1 |
| 4,304,385 | A | * | 12/1981 | Farouche et al. | 248/182.1 |
| 5,024,175 | A | * | 6/1991 | Epstein | 112/217.2 |
| 5,749,556 | A | * | 5/1998 | Matsuoka et al. | 248/349.1 |
| 5,765,796 | A | * | 6/1998 | Lanus | 248/349.1 |
| 6,231,020 | B1 | * | 5/2001 | Willson | 248/349.1 |

FOREIGN PATENT DOCUMENTS

| | | | | |
|---|---|---|---|---|
| DE | 3245549 | * | 8/1983 | 112/217.1 |
| RU | 163063 | * | 5/1964 | 112/217.3 |

* cited by examiner

*Primary Examiner*—Ismael Izaguirre
(74) *Attorney, Agent, or Firm*—Eugene E. Renz, Jr.

(57) ABSTRACT

A system facilitating the use of multiple sewing machines mounted on a sewing cabinet is disclosed. A circular turntable on which multiple sewing machines are mounted can be activated either manually or with an electric motor to rotate a desired sewing implement to the working position. The cabinet is designed for maximum storage space in a minimum of wall space. Different models provide up to five drawers and eight shelve as well as a drop leaf for increased table area. The system has surge protected outlets with an on/off switch and an electric cord that can be plugged into any household outlet.

8 Claims, 10 Drawing Sheets

MULTIPLE POSITION SEWING SYSTEM

FIELD OF THE INVENTION

This application claims the benefit of U.S. Provisional Application No. 60/252,056 filed Nov. 20, 2000.

The present invention relates to a system for facilitating the use of several appliances, machines, tools from a single work position and without the necessity of removing and replacing a desired sewing machine or tool implement. More particularly, the invention relates to a system comprising a turntable apparatus adapted to the top of any cabinet/workbench/table wherein several appliances, machines, tools are mounted or placed and can be rotated into the work position. Rotating the turntable can be manually or electric motor driven.

SUMMARY OF THE INVENTION

It is noted that the features of the present invention have application in many fields as noted above. However, the features have particular application to sewing systems.

In accordance with the present invention, there is provided a sewing system comprising a unique rotating turntable for mounting several sewing implements and a cabinet with drop leaves, drawers and shelves. For space utilization efficiency, equal amounts of the front and back of the turntable rotating mounting platform can be removed so as to form a straight edge on the front and back of the cabinet top. All drawers use all the depth available, some with the use of full extension drawer slides. The remaining available space has adjustable shelves.

The present invention provides a space-saver model for use in areas where space is at a premium are provided. This sewing system is designed to utilize the cabinet top for mounting several types of machines, such as a sewing machine, and provide adequate storage space in the form of up to five drawers and eight shelves. A minimum of four surge protected outlets are provided with an on/off switch and a heavy-duty electric cord out the back of the table that can be plugged into any household outlet.

The turntable assembly comprises a turntable attached to the upper plate of a ball bearing metal raceway. The lower plate of the ball bearing race is bolted to the cabinet top. The upper plate and the attached turntable, therefore, are free to rotate on the ball bearing lower plate race. A circular groove in the cabinet top forms a track way for a spring-loaded locking pin that protrudes through the turntable into the circular track way. Locking holes in the circular groove allow the spring-loaded locking pin to drop into the locking holes thereby providing means for locking the turntable in a desired position. A knob-like handle on the spring-loaded locking pin provides the means for manually rotating the turntable.

A second embodiment provides a motor and gear arrangement to rotate the turntable. The mounting platform, in this embodiment, is attached to a large circular gear whose teeth engage a smaller drive gear attached to the drive shaft of an electric motor. The electric motor is switch activated to rotate the turntable. Stops on the large driven gear engage a switch arrangement to reverse motor current thereby reversing the direction of the turntable and preventing the turntable from continuing to rotate beyond 355°.

With the above in mind, an object of the present invention is to provide a system for rotating multiple implements into a work position which is characterized by novel features of construction and arrangement including means for plugging in the appliances, machines, tool, etc., incorporating a surge protection.

Another object of the present invention is to provide a system for rotating multiple implements into a work position incorporating a turntable which can only be rotated 355° and in this matter preclude any of the cord extensions from becoming entangled.

Still another object of the present invention is to provide a system of the type disclosed wherein a wire race keeps the cores from interfering with a drawer directly under the turntable.

Still a further object of the present invention is to provide a system for rotating multiple implements into a work position, incorporating a knee switch for revolving and changing direction of the turn table.

A still further object of the present invention is to provide a system wherein the stops at the end of the 355° rotation reverses rotation of the switch as well as being able to change direction with turning the switch off and then back on.

Still another object of the present invention is to provide a system wherein the manual turntable locks into aposition with a spring-loaded locking pin at a predetermined location which the electric turntable locks into position wherever it stops and is held by a gearing system.

BRIEF DESCRIPTION OF THE FIGURES

These and other objects of the present invention and various features and details of the operation and construction thereof are hereinafter more fully set forth with reference to the accompanying drawings, wherein.

DESCRIPTION OF THE PREFERRED EMBODIMENTS

It will be appreciated by those skilled in the art that the turntable system described hereinafter has application to many different kinds of appliances, machines, and tools. For example, the turntable system of the present invention may find application in a motorized turntable wherein several kitchen appliances are mounted such as a mixer, electric can opener, blender and the like. To illustrate the principles of the present invention, a sewing machine application is described.

Figure 1:
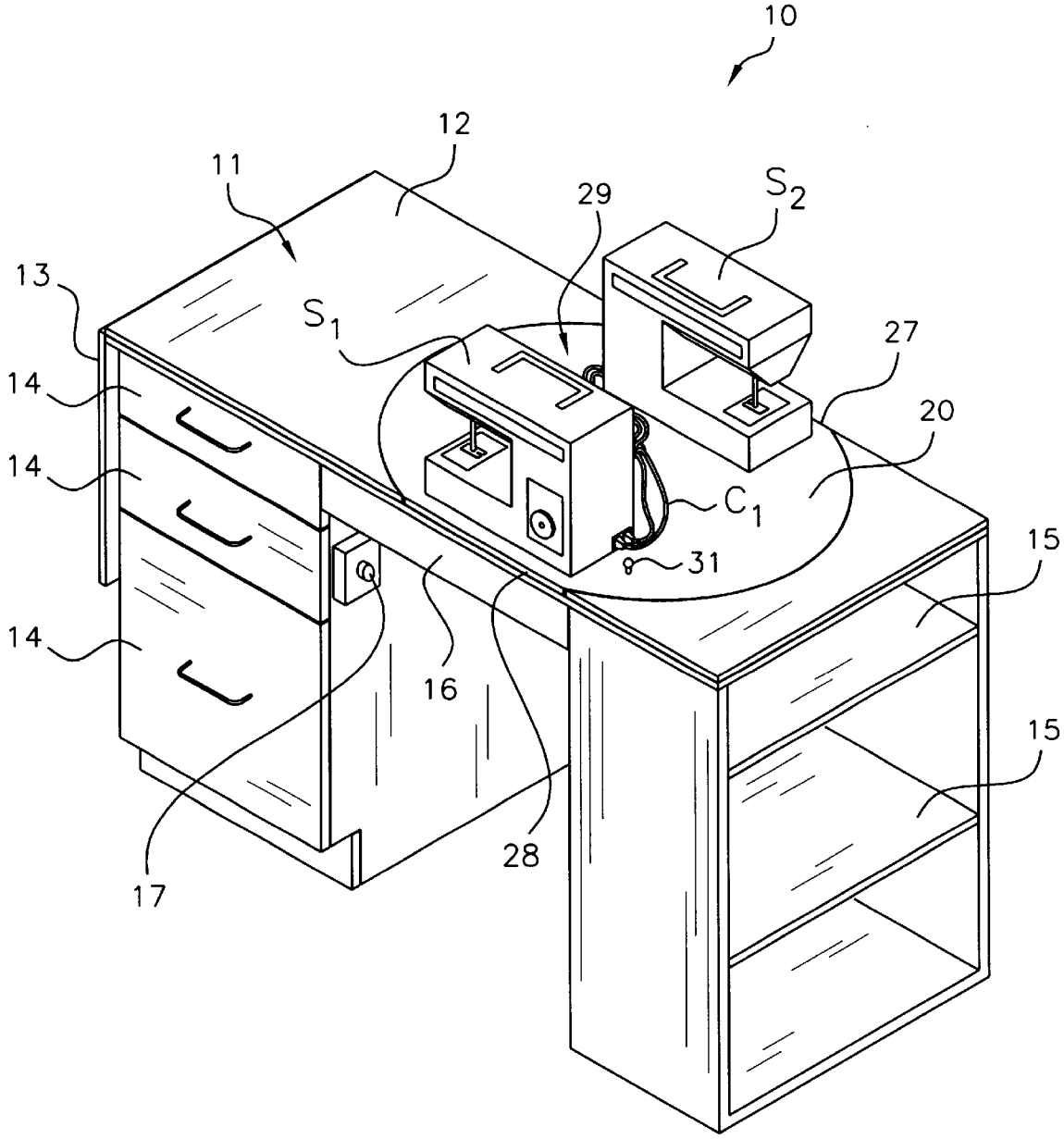
FIG. 1 is a perspective view of a typical configuration of the present invention with two sewing machines mounted on a rotating table that is integral with a sewing cabinet.

Referring now to FIG. 1, there is shown a sewing system 10 of the present invention comprising a generally rectangular shaped sewing cabinet 11, turntable 20, and sewing machines $S_1$ and $S_2$. Sewing cabinet 11 is illustrative of one of several sewing cabinet models having a cabinet top 12, drop leaf 13 on one side of sewing cabinet 11, drawers 14 for storing sewing accessories and file folders, adjustable shelves 15, a center kneehole drawer 16, and a knee activated switch 17. Shelves (not shown) may also be provided at the form and potion of knee hole. Sewing system 10 is illustrated in a typical configuration with drop leaf 13 in a down position, sewing machine $S_1$ on turntable 20 is in the work position and sewing machine $S_2$ in an idle position. Electrical power cords $C_1$ and $C_2$ extending from $S_1$ and $S_2$ are routed through spindle opening 19 (see FIG. 2) on turntable 20 to a power receptacle (not shown) attached within kneehole of sewing cabinet 11. Turntable 20 is positioned in a recessed circular cut out 18 (FIG. 5) on cabinet top 12 of sewing cabinet 11 such that cabinet top 12 and turntable 20 are coplanar with no height discontinuities. Equal amounts of the front and back of turntable 20 are removed so as to form straight edges 27 and 28 on the front and back so as to conform to cabinet 11 width dimension.

Figure 2:
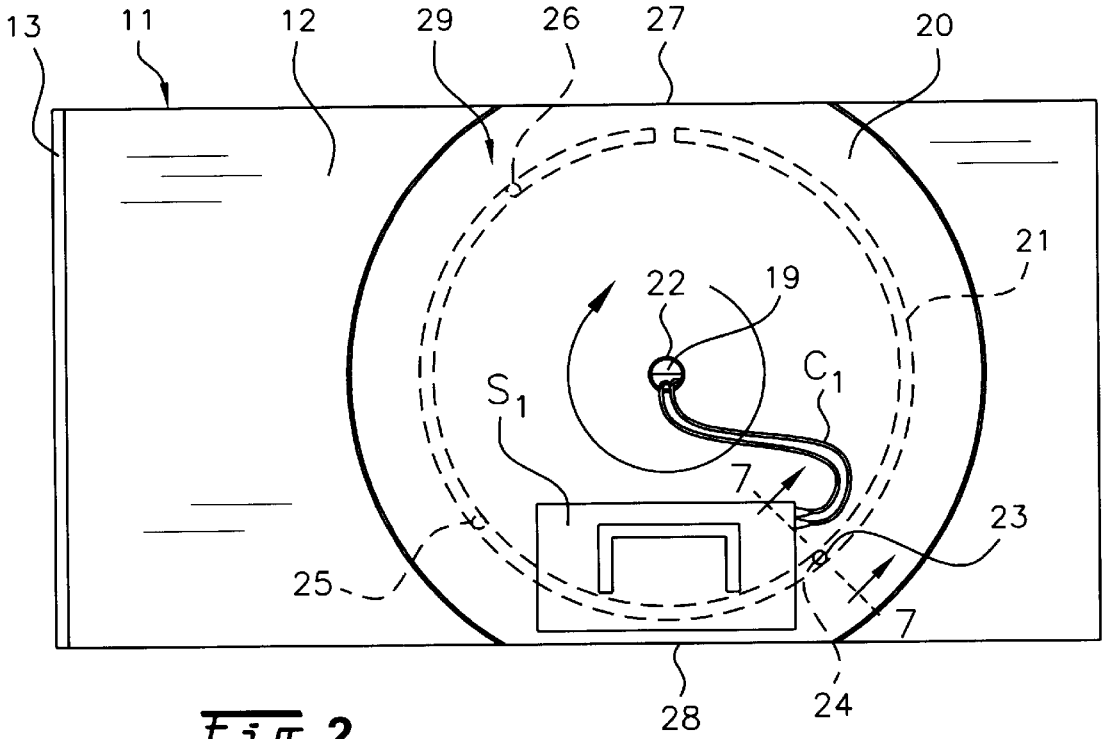
FIG. 2 is a top view of the turntable with a sewing machine in the work position and a power cord leading from the sewing machine to a center opening in the turntable and wherein the groove within the rotating turntable is shown in phantom. Only one sewing implement is shown although several machines can be mounted on the turntable.
Figure 3:
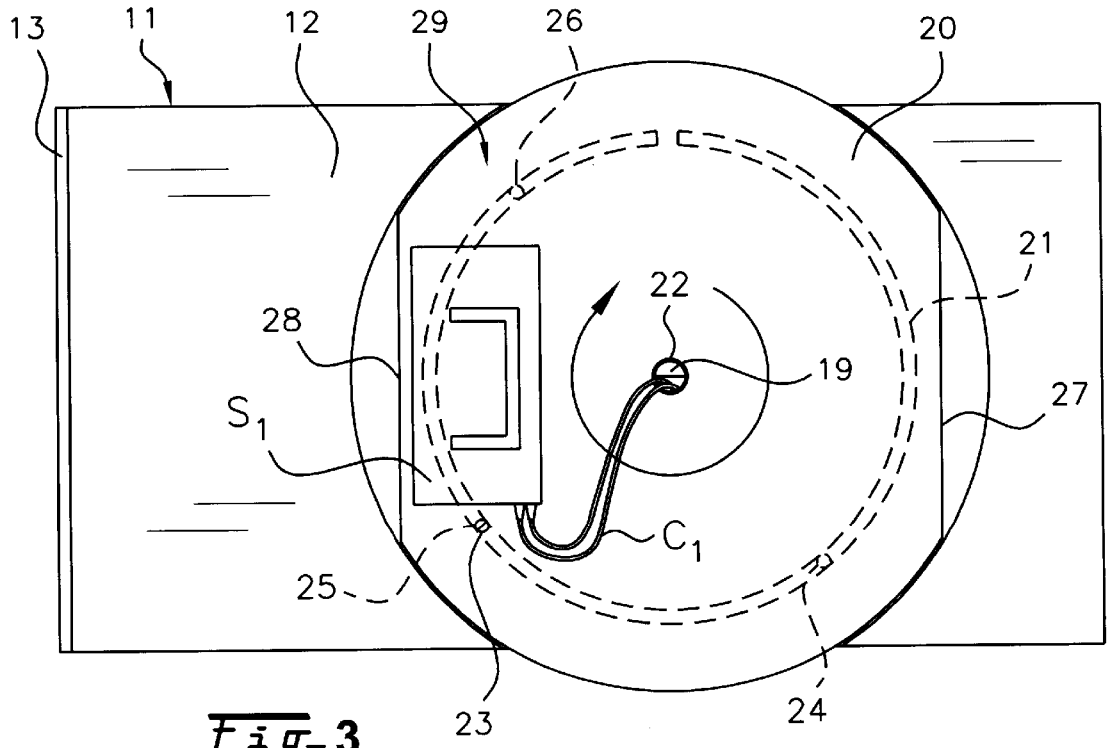
FIG. 3 is a top view similar to FIGS. 1 and 2 and illustrates the process of rotating the sewing machine to another position.
Figure 4:
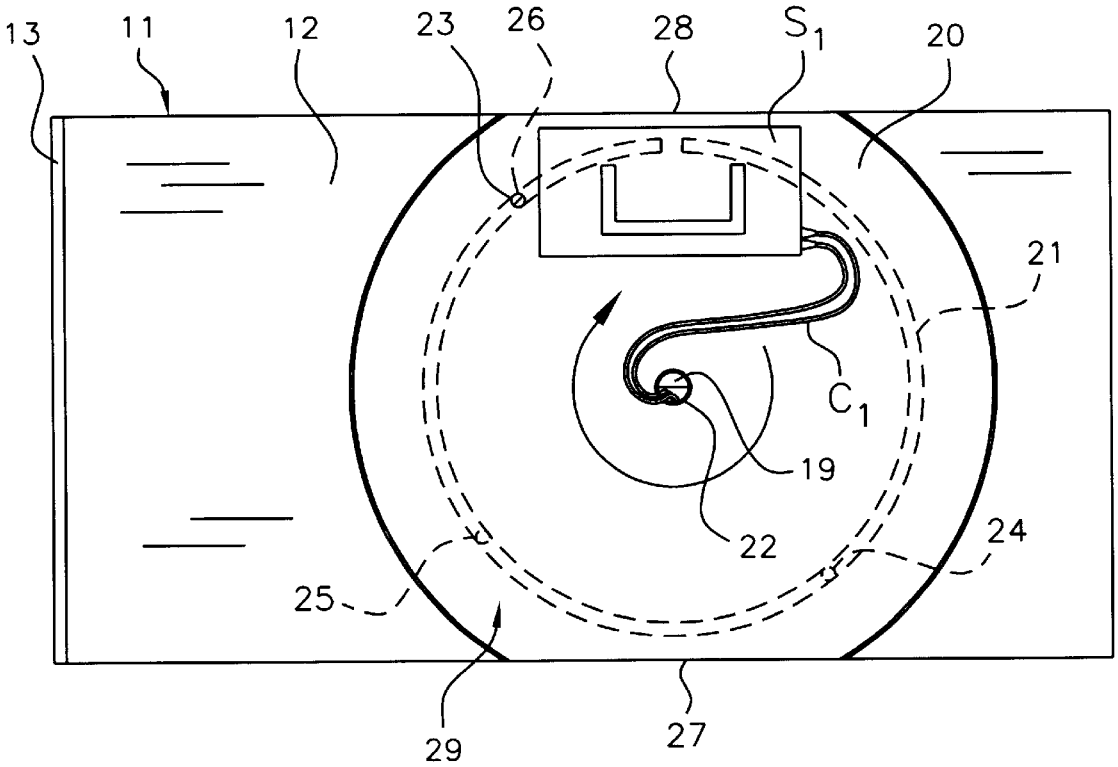
FIG. 4 is a top view similar to FIGS. 2 and 3 with a sewing machine rotated 180° from its original position.
Figure 5:
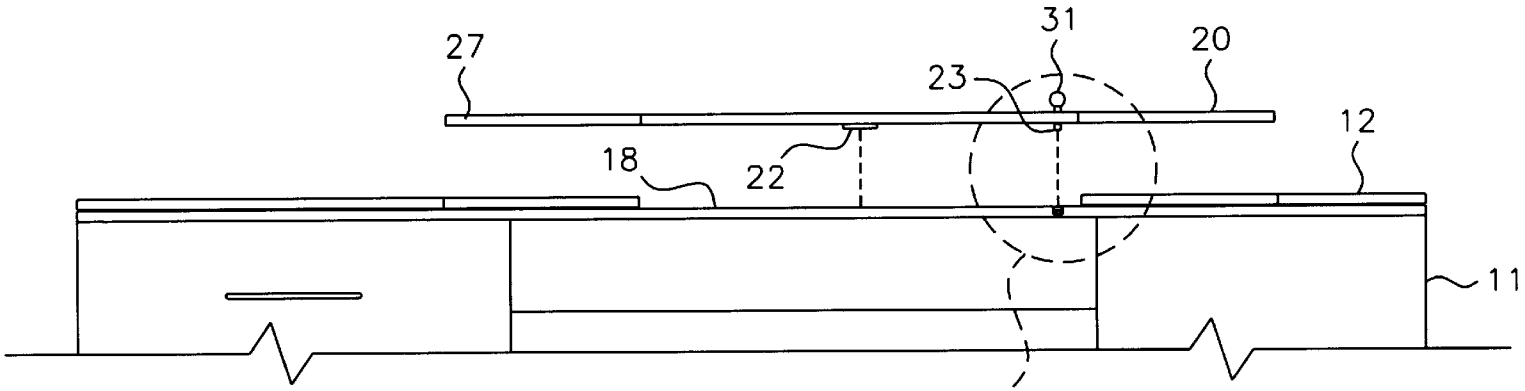
FIG. 5 is a partial front view of the turntable system with the turntable elevated showing the turntable, locking pin, and groove.
Figure 7:
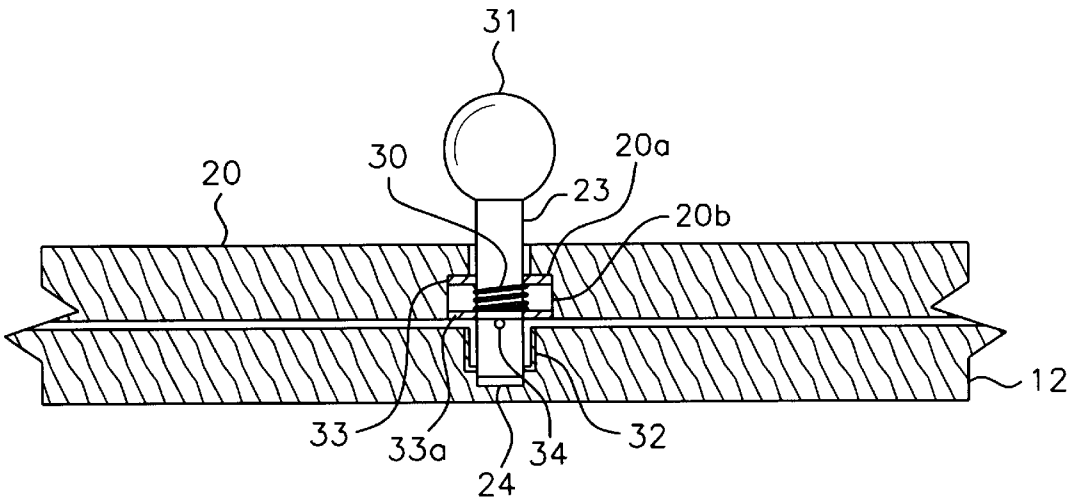
FIG. 7 is an enlarged, fragment sectional view taken on line 7—7 of FIG. 2 with locking pin engaged in a stop position in the track.
Figure 6:
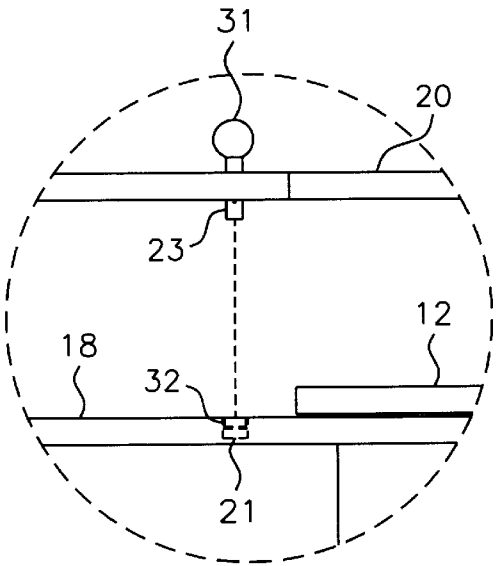
FIG. 6 is an enlarged exploded view of the locking pin and track.

Top views of turntable 20 on cabinet top 12 of cabinet 11 shown in FIGS. 2, 3, and 4 with sewing machine $S_2$ removed for clarity purposes, illustrate positional accommodation of sewing system 10. A 355° channel cut into cabinet top 12 of cabinet 11 constitutes a circular track 21 that guides turntable 20 to user desired positions. In FIGS. 5, 6 and 7 rotation handle 31 and locking pin 23 ride on a circular metallic insert 32 embedded in circular track 21 providing means for manually rotating sewing machines S1 and S2 from one position to another. Locking holes are formed by drilling through metallic insert 32 and partially into cabinet top l2 within the channel of circular track 21. Locking holes 24, 25, and 26 are typical examples of pre-positioned stops on circular track 21 although stops may be positioned anywhere along circular track 21 at the discretion of the user. Spring 30 is compressed when locking pin 23 is riding on metallic insert 32. When a locking hole is encountered, spring 30 forces locking pin 23 into a locking hole thus preventing further rotation until locking pin 23 is manually lifted out of the locking hole. In FIG. 2, locking pin 23 is engaged in locking hole 24. Likewise, in FIG. 3, turntable 20 has been rotated 90° and locking pin 23 is engaged in locking hole 25. In FIG. 4, sewing machine $S_1$ is shown rotated approximately 180° from its original position with locking pin 23 inserted in locking hole 26. Electrical power cords $C_1$ and $C_2$ are fed through spindle opening 19 in the center of turntable 20 and routed through cutout 40 shown in FIGS. 8A and 8B to electrical receptacle (not shown) on the underside of cabinet top 12. Closure 41 retains electrical cord $C_1$ in cutout 40 and prevents electrical cord $C_1$ from sagging and becoming entangled. This arrangement allows electric power cords $C_1$ and $C_2$ to move with sewing machine $S_1$ an $S_2$ without constraining rotational motion.

Figure 7A:
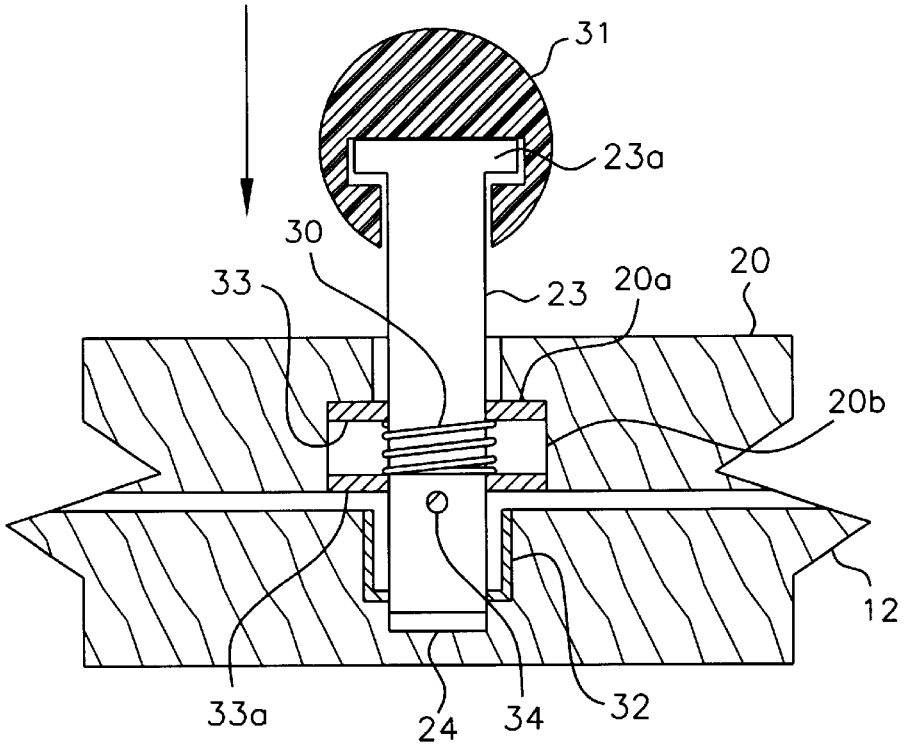
FIG. 7A is a further enlarged view of FIG. 7 showing details of the locking pin.
Figure 7B:
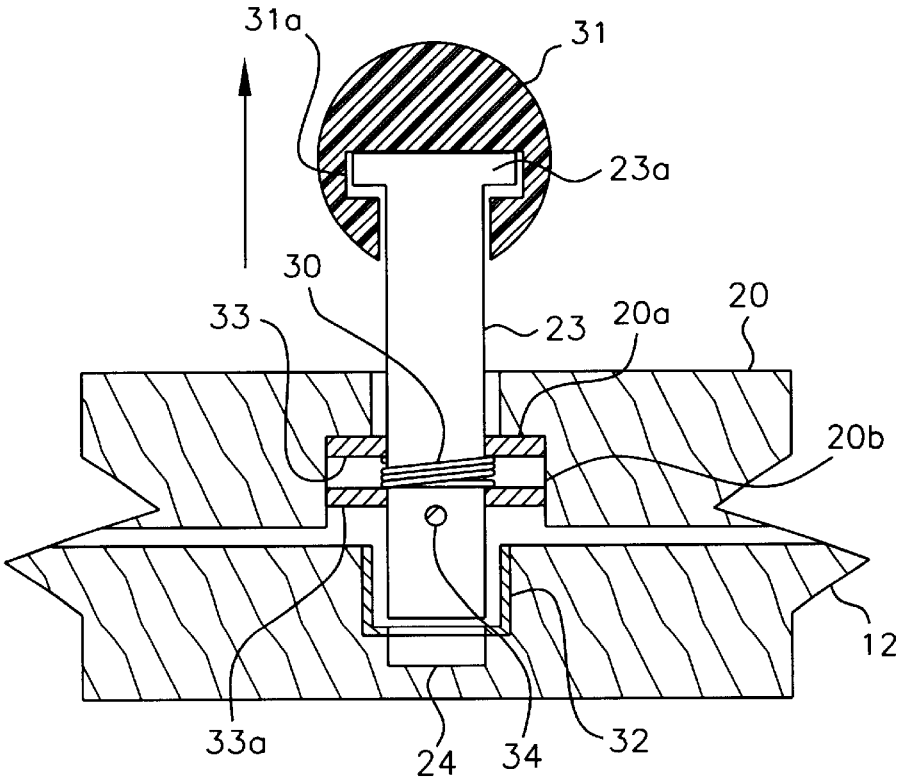
FIG. 7B is a view similar to FIG. 7A with the locking pin disengaged from its stop position.

Details of the manual version of sewing system 10 are illustrated in FIGS. 5, 6, and 7 and is comprised of turntable 20, spindle shaft 22, locking pin 23, circular track 21, spring 30, rotation handle 31, and metallic insert 32 in circular track 21. FIG. 7 is an enlarged assembly view of locking pin 23 and rotation handle 31. Spring 30 is compression biased between upper and lower spring retainers 33 and 33*a* respectively so that a downward force is continually exerted on locking pin 23. Cotter pin 34 maintains lower spring retainer 33*a* on locking pin 23 while shoulder 20*a* in inverted T shaped circumferential groove 20*b* in turntable 20 retains upper spring retainer 33 on locking pin 23. FIGS. 7A and 7B are expanded detail views showing the operation of locking pin 23. The flanged upper end 23*a* of locking pin 23 is retained within an internal slot 31*a* of rotation handle 31 such that when rotating turntable 20, handle 31 is free to rotate on locking pin 23 thereby allowing locking pin 23 to remain in a fixed orientation. In FIG. 7A, it can be seen that locking pin 23 through the action of compression biased spring 30 has been inserted in locking hole 24 while in FIG. 7B a manual upward force has released locking pin 23 from locking hole 24 allowing turntable 20 to be rotated.

Figure 13:
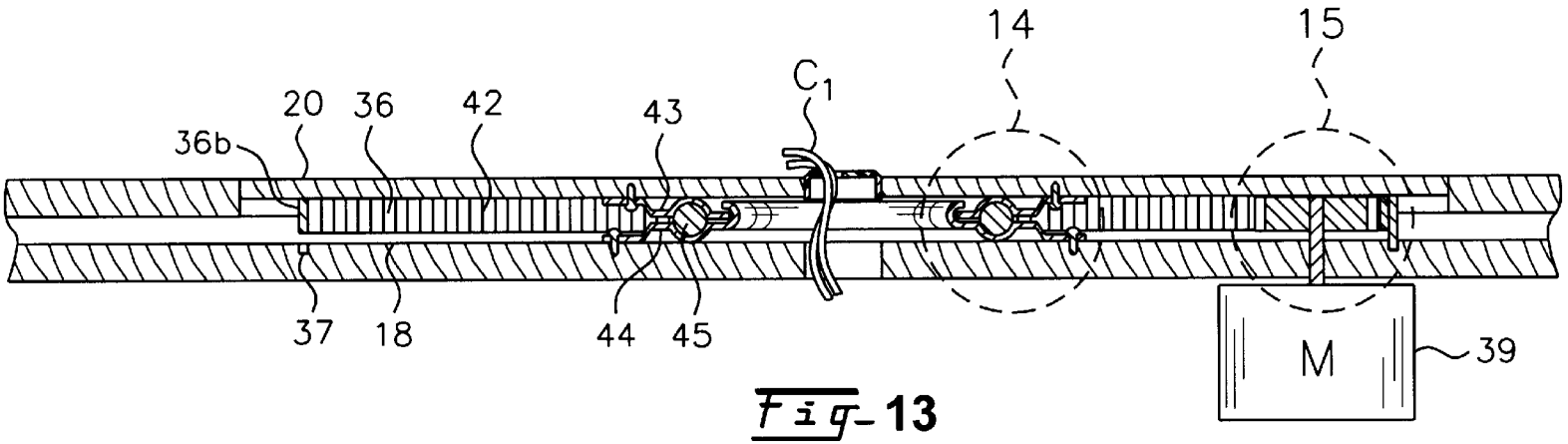
FIG. 13 is a sectional front view of the turntable assembly and motor taken along line 13—13 of FIG. 9.
Figure 14:
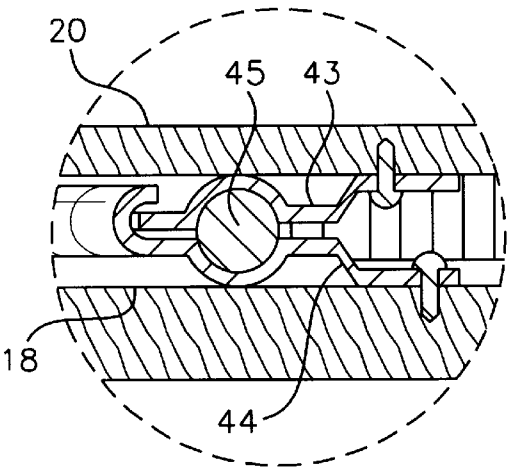
FIG. 14 is an enlarged view of circled view 14 of FIG. 13 illustrating details of the attachment of ball bearing supported turntable assembly.

When assembled turntable 20 is secured to cabinet top 12 by ball bearing raceway 42 as shown in FIGS. 13 and 14. To rotate turntable 20, on ball bearing raceway 42, locking pin 23 is released from its locking hole 24 with an upward pull on rotation handle 31 compressing spring 30. Turntable 20 can then be rotated in circular track 21 to a new position. When the new position is reached rotation handle 31 is released forcing locking pin 23 into a new locking hole as shown in FIGS. 3 and 4.

Figure 8:
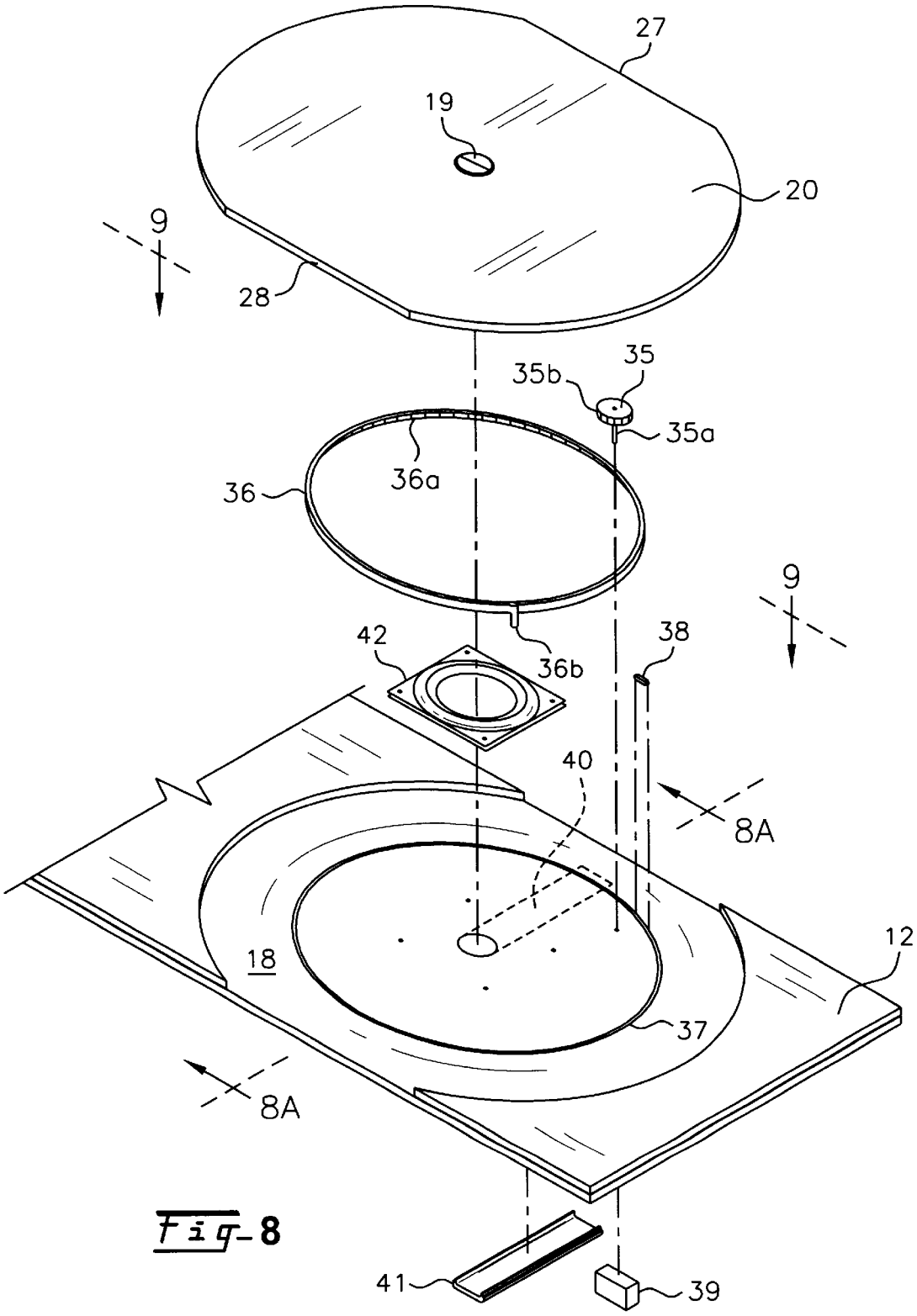
FIG. 8 is an exploded view of turntable construction elements and assembly.
Figure 8A:
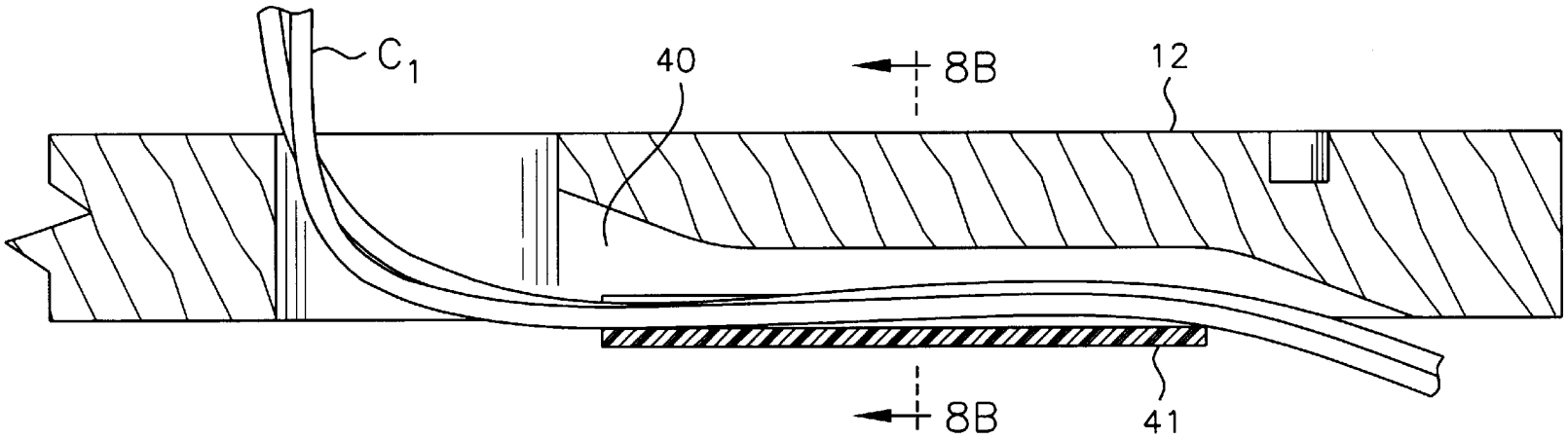
FIG. 8A is a partial section elevation view of the turntable support illustrating the power cord cutout and cutout cap.
Figure 8B:
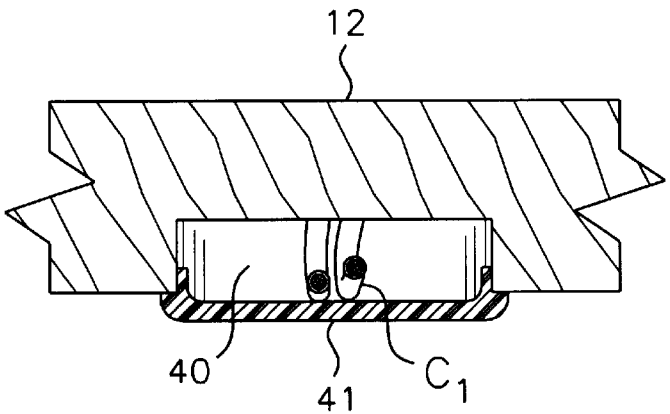
FIG. 8B is a view taken along line 8B—8B of FIG. 8A showing the power cord cutout and cutout cap.
Figure 9:
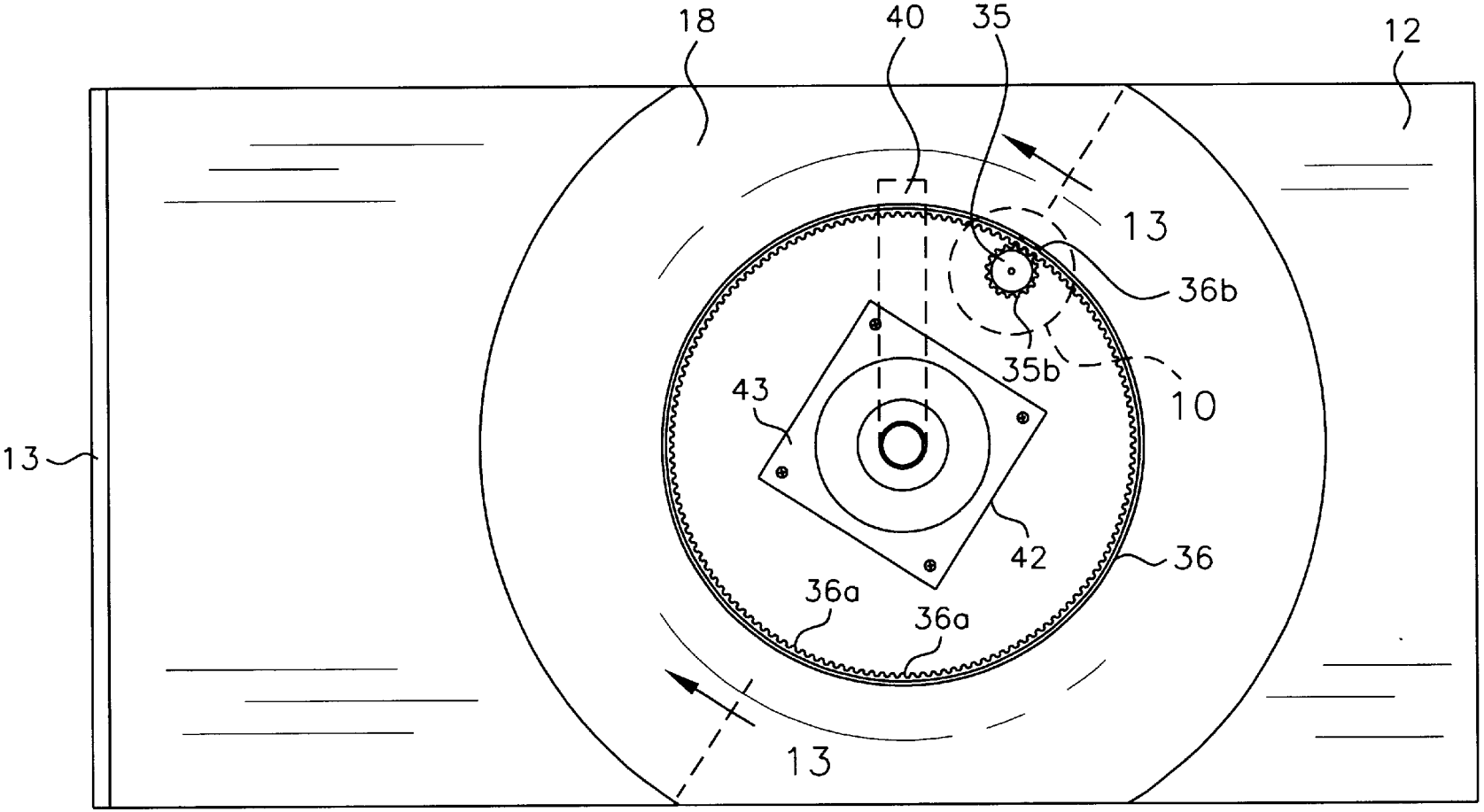
FIG. 9 is a top view of the turntable assembly with the mounting plate removed to show the motorized gear mechanism for rotating the turntable.
Figure 12:
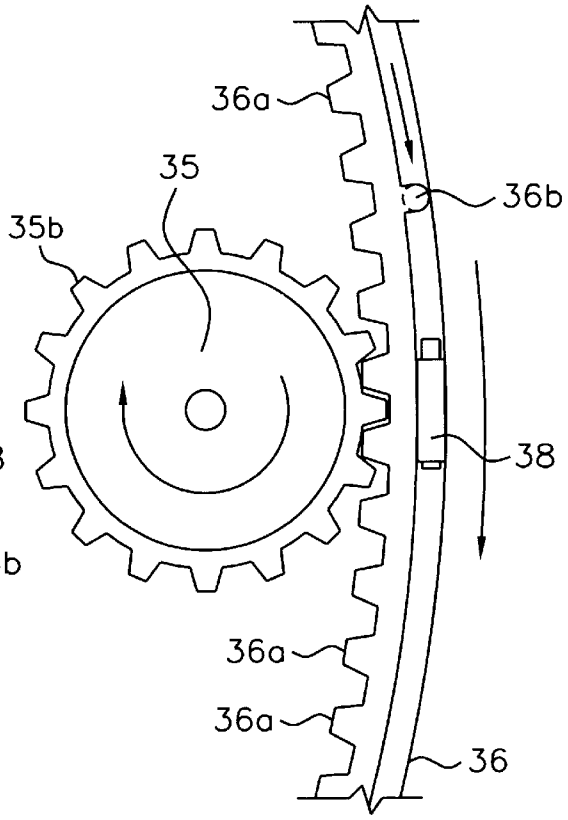
FIG. 12 is a fragmentary view with the motor turning the drive gear in a clockwise direction, the stop projection on the driven gear has rotated approximately 355° and is approaching the reversing switch in the opposite direction.
Figure 11:
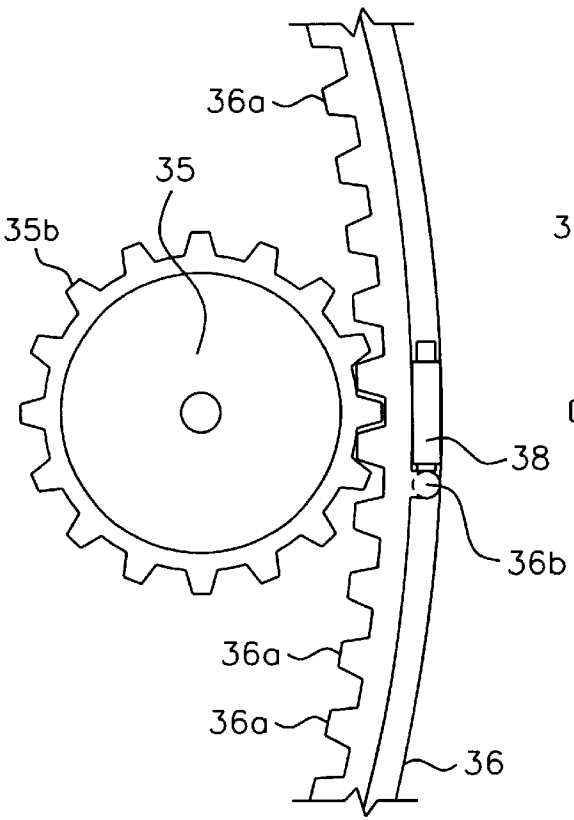
FIG. 11 is a fragmentary view of the drive gear mechanism showing the stop projection depressing the plunger of the reversing switch.
Figure 10:
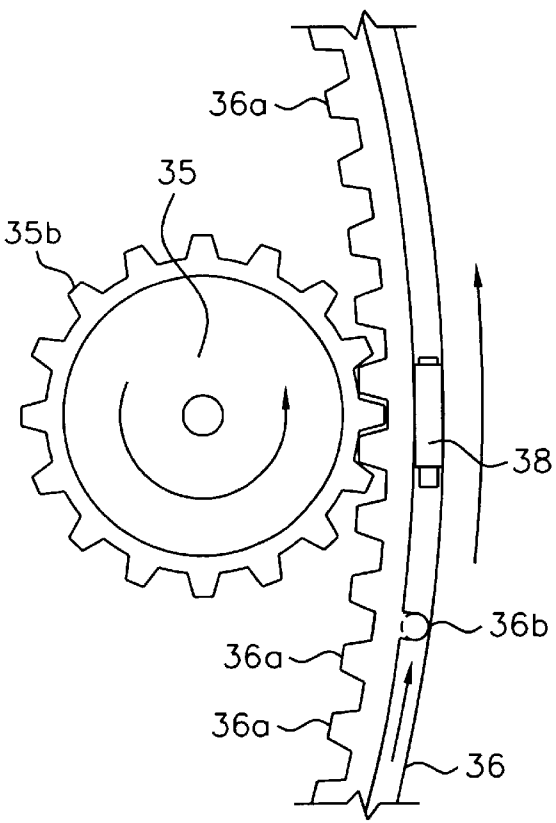
FIG. 10 is a fragmentary view of the gear mechanism with the drive gear rotating in a counter clockwise direction. The stop projection on the driven gear is approaching the fixed reversing switch.
Figure 15:
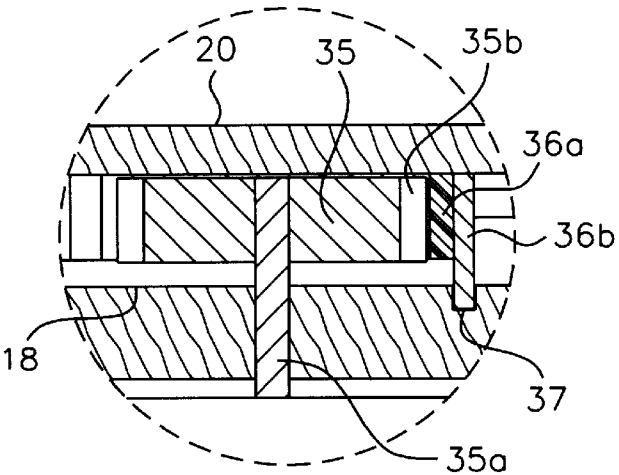
FIG. 15 is an enlarged view of circled view 15 of FIG. 13 illustrating details of the drive and driven gears of the motorized turntable assembly.

A motorized embodiment of sewing system 10 is shown in an exploded view in FIG. 8 and is comprised of turntable 20, spindle shaft 22, drive gear 35, drive shaft 35*a*, driven gear 36, ball bearing raceway 42, reversing switch 38, and electric motor 39. Motorized turntable 20 is positioned in a recessed circular cut out 18 on cabinet top 12 such that cabinet top 12 and turntable 20 are coplanar with no height discontinuities. Equal amounts of the front and back of turntable 20 are removed so as to form straight edges 27 and 28 conforming to sewing cabinet 11 width dimension. Electrical Cord $C_1$ from sewing machine $S_1$ to electrical outlet (not shown) is routed through cutout 40 on the under surface of cabinet top 12. Electrical cord $C_1$ is supported in cutout 40 by closure 41 which snaps into cutout 40 thereby constraining electrical cord $C_1$ and preventing entanglement as shown in FIGS. 8A and 8B. Referring again to FIG. 8, drive shaft 35*a* is connected to electric motor 39. Driven gear 36 has internal gear teeth 36*a* and is attached to the underside of turntable 20. Referring now to FIG. 9 in conjunction with FIGS. 13, 14, and 15, top plate 43 of ball bearing raceway 42 and driven gear 36 are bolted to turntable 20. Bottom plate 44 of ball bearing raceway 42 is bolted to recess 18 of cabinet top 12. Top plate 43 is free to rotate on ball bearings 45 while bottom plate 44 remains stationary. When power is applied to electric motor 39, it rotates drive gear 35 whose teeth 35*b* are in meshed contact with gear teeth 36*a* of driven gear 36 causing driven gear 36, turntable 20, and top plate 43 to rotate. Turntable 20 may be stopped at any position within its 355° travel by simply removing power to electric motor 39. When turntable 20 has reached its travel limit in one direction, means are provided to reverse motor 39 polarities to rotate turntable 20 in the opposite direction. Referring now to FIGS. 10, 11, and 12, pin 36*b* on the outer perimeter of driven gear 36 rides in channel 37 and when in contact with reversing switch 38, power to motor 39 is reversed turning drive gear 35 in the opposite direction and counter rotating driven gear 36. In this motorized embodiment, switch 45 prevents rotation beyond 355°. When pin 36*b* on the outer perimeter of driven gear 43 as shown in FIGS. 10 and 11, contacts switch 38, power to motor 39 is reversed turning drive gear 35 in the opposite direction and counter rotating driven gear 36 as shown in FIG. 12.

Even though particular embodiments of the present invention have been illustrated and described herein, it is not intended to limit the invention and changes and modifications may be made therein within the scope of the following claims.

What is claimed is:

1. A sewing system for rotating multiple sewing implements into the work position and mounted on a multi-purpose sewing cabinet, said system comprising:

a turntable apparatus adapted to the top of said cabinet and wherein multiple sewing implements can be mounted and rotated into a work position;

a circular mounting surface for positioning said sewing implements;

a drive gear attached to an electric motor for rotating said circular mounting surface;

a circular gear attached to said circular mounting surface and meshed with said drive gear and wherein said circular gear has a protruding element on its outer periphery;

a ball bearing raceway between an upper and lower plate wherein said upper plate is attached to said circular mounting surface and said lower plate is attached to said cabinet top;

an electric motor for providing drive torque to said drive gear; and a switch activated by said protruding element on said periphery of said circular gear for controlling and reversing current to said motor.

2. A system for rotating multiple implements into the work position and mounted on a multi-purpose cabinet, said system comprising:

a) a turntable apparatus adapted to the top of said cabinet and wherein multiple implements can be mounted and rotated into a work position;

b) a circular mounting surface for mounting said implements; a circular track in top of said cabinet for guiding the rotation of said circular mounting surface;

c) a ball bearing raceway between an upper and lower plate wherein said upper plate is attached to said circular mounting surface and said lower plate is attached to said cabinet top;

d) means for manually rotating said circular mounting surface on said ball bearing raceway;

e) locking means in said circular track for positioning and locking said circular mounting surface;

f) spring loaded means for guiding said circular mounting surface in said circular track and for inserting into said locking means locking said implements in a work position; and g) means for preventing rotation of said circular mounting surface through an angle of more than 360°.

3. A system for rotating multiple implements into the work position and mounted on a multi-purpose cabinet, said system comprising:

a) a turntable apparatus adapted to the top of said cabinet and wherein multiple implements can be mounted and rotated into a work position, b) a circular mounting surface for mounting said implements;

c) a circular track in top of said cabinet for guiding the rotation of said circular mounting surface;

d) a ball bearing raceway between an upper and lower plate wherein said upper plate is attached to said circular mounting surface and said lower plate is attached to said cabinet top;

e) means for manually rotating said circular mounting surface on said ball bearing raceway;

f) locking means in said circular track for positioning and locking said circular mounting surface;

g) spring loaded means for guiding said circular mounting surface hi said circular track and for inserting into said locking means locking said implements in a work position;

h) wiring means connecting the implements to a source of power running from the implement through an opening centrally located in the turntable to the source of power;

i) means for preventing rotation of said circular mounting surface through an angle of more than 360°.

4. A sewing system, for rotating multiple sewing implements into the work position and mounted on a multi-purpose sewing cabinet, said system comprising:

a) a turntable apparatus adapted to the top of sad cabinet and wherein multiple sewing implements can be mounted and rotated into a work position;

b) a circular mounting surface for mounting said sewing implements;

c) a circular track in top of said cabinet for guiding the rotation of said circular mounting surface;

d) a ball bearing raceway between an upper and lower plate wherein said upper plate is attached to said circular mounting surface and said lower plate is attached to said cabinet top;

e) handle means for manually rotating said circular mounting surface on said ball bearing raceway, f) locking holes in said circular track for positioning and locking said circular mounting surface;

g) spring loaded locking pins for guiding said circular mounting surface in said circular track and for inserting into said locking holes locking said sewing implements cuts in position; and h) means for preventing rotation of said circular mounting surface through an angle of more than 360°.

5. A sewing system for rotating multiple sewing implements into the work position and mounted on a multipurpose sewing cabinet, said system comprising:

a) a turntable apparatus adapted to the top of said cabinet and wherein multiple sewing implements can be mounted and rotated into a work position;

b) a circular mounting surface for mounting said sewing implements;

c) a circular track in top of said cabinet for guiding the rotation of said circular mounting surface;

d) a ball bearing raceway between an upper and lower plate wherein said upper plate is attached to said circular mounting surface and said lower plate is attached to said cabinet top;

e) handle means for manually rotating said circular mounting surface on said ball bearing raceway;

f) locking holes in said circular track for positioning and locking said circular mounting surface;

g) spring loaded locking pins for guiding said circular mounting surface in said circular track and for inserting into said locking holes locking said sewing implements in position;

h) means for preventing rotation of said circular mounting sure through an angle of more than 360°; and i) wiring means connecting the implements to a source of power running from the implement through an opening centrally located in the turntable to the source of power.

6. A top for a system accommodating multiple implements which may be selectively positioned in various work positions comprising:

a) an elongated, generally rectangular base panel;

b) a pair of spaced top panels having sides conforming generally to the side and end edges of the base panel and having arcuate spaced confronting edges, which lie on the circumference of a common circle;

c) a turn table panel for mounting the multiple implements of generally oval-shaped configuration having diametrically opposed arcuate edges conforming to the confronting arcuate edges in the top panels;

d) intermediate planar side edges which are parallel and spaced apart at a distance equal to the width of the base panel; and e) means for preventing rotation of said circular mounting surface through an angle of more than 360°.

7. A top for a system accommodating multiple implements which may be selectively positioned in various work positions comprising:

a) an elongated, generally rectangular base panel;

b) a pair of spaced top panels having sides conforming generally to the side and end edges of the base panel and having arcuate spaced confronting edges, which lie on the circumference of a common circle;

c) a turn table panel for mounting the multiple implements of generally oval-shaped configuration having diametrically opposed arcuate edges conforming to the confronting arcuate edges in the top panels; and d) intermediate planar side edges which are parallel and spaced apart at a distance equal to the width of the base panel; and e) wiring means connecting the implements to a source of power running from the implement through an opening centrally located in the turntable to the source of power.

8. A top for a system accommodating multiple implements which may be selectively positioned in various work positions comprising:

a) an elongated, generally rectangular base panel;

b) a pair of spaced top panels having sides conforming generally to the side and end edges of the base panel and having arcuate spaced confronting edges, which lie on the circumference of a common circle;

c) a turn table panel for mounting the multiple implements of generally oval-shaped configuration having diametrically opposed arcuate edges conforming to the confronting arcuate edges in the top panels; and d) intermediate planar side edges which are parallel and spaced apart at a distance equal to the width of the base panel;

e) wiring means connecting the implements to a source of power running from the implement through an opening centrally located in the turntable to the source of power; and f) means for preventing rotation of said circular mounting surface through an angle of more than 360°.

* * * * *